US010806274B2

(12) United States Patent
Gersin

(10) Patent No.: US 10,806,274 B2
(45) **Date of Patent: *Oct. 20, 2020**

(54) PORTABLE VIBRATING BABY SOOTHING MAT

(71) Applicant: Tranquilo, LLC, Cambridge, MA (US)

(72) Inventor: Melissa G. Gersin, Providence, RI (US)

(73) Assignee: Tranquilo, Inc., Cambridge, MA (US)

( * ) Notice: Subject to any disclaimer, the term of this patent is extended or adjusted under 35 U.S.C. 154(b) by 40 days.

This patent is subject to a terminal disclaimer.

(21) Appl. No.: 15/159,981

(22) Filed: May 20, 2016

(65) Prior Publication Data

US 2016/0278539 A1 Sep. 29, 2016

Related U.S. Application Data

(63) Continuation-in-part of application No. 14/454,082, filed on Aug. 7, 2014, now Pat. No. 9,357,855.
(Continued)

(51) Int. Cl.
*A47D 15/00* (2006.01)
*A47C 21/00* (2006.01)
(Continued)

(52) U.S. Cl.
CPC ..... *A47D 15/003* (2013.01); *A47C 21/006* (2013.01); *A47C 21/048* (2013.01);
(Continued)

(58) Field of Classification Search
CPC .. A47D 15/001; A47D 15/003; A47C 21/006; A47C 21/048; A47G 9/06; A47G 9/062; A61H 2201/0146; A61H 23/0263
See application file for complete search history.

(56) References Cited

U.S. PATENT DOCUMENTS 2,924,216 A * 2/1960 Stewart ..... A61H 23/0263 601/60
2,943,620 A 7/1960 Sibert
(Continued)

FOREIGN PATENT DOCUMENTS

WO 2010149766 A1 12/2010

OTHER PUBLICATIONS

Merriam-Webster Dictionary, Definition of Roll, Jun. 12, 2018. (Year: 2018).*
(Continued)

*Primary Examiner* — Nicholas F Polito
(74) *Attorney, Agent, or Firm* — Hunton Andrews Kurth LLP

(57) ABSTRACT

A flexible vibrating mat for soothing a child includes a plurality of electric vibratory motors and a plurality of cylindrical motor casings. Each motor casing is associated with a single electric vibratory motor and is generally the same size as the associated electric vibratory motor. The mat additionally includes a controller. The controller is configured to selectively electrically couple the plurality of electric vibratory motors to an electric power supply. The mat further includes a flexible core coupled with the plurality of motor casings and a water-resistant cover covering the core, the plurality of motor casings, and the controller.

21 Claims, 5 Drawing Sheets

Related U.S. Application Data

(60) Provisional application No. 61/836,905, filed on Jun. 19, 2013.

(51) Int. Cl.
*A61H 23/02* (2006.01)
*A47C 21/04* (2006.01)

(52) U.S. Cl.
CPC ..... *A47D 15/001* (2013.01); *A61H 23/0263* (2013.01); *A61H 2023/0272* (2013.01); *A61H 2201/0111* (2013.01); *A61H 2201/0146* (2013.01); *A61H 2201/0157* (2013.01); *A61H 2201/0207* (2013.01); *A61H 2201/0228* (2013.01); *A61H 2201/1215* (2013.01); *A61H 2201/5028* (2013.01); *A61H 2201/5048* (2013.01); *A61H 2201/5097* (2013.01); *A61H 2203/0443* (2013.01); *A61H 2230/805* (2013.01)

(56) References Cited

U.S. PATENT DOCUMENTS 3,292,611 A 12/1966 Belkin
4,066,072 A * 1/1978 Cummins ..... A47C 27/085 128/903
4,141,095 A 2/1979 Adachi
4,188,988 A * 2/1980 Agyagos ..... A45C 3/00 190/2
4,489,815 A * 12/1984 Martinez ..... A45C 9/00 190/1
4,620,334 A 11/1986 Robinson
4,656,680 A 4/1987 Wilson
4,681,096 A 7/1987 Cuervo
4,785,797 A 11/1988 Cuervo
4,872,229 A * 10/1989 Brady ..... A47C 27/081 5/694
4,935,972 A * 6/1990 Brady ..... A47C 27/081 4/575.1
4,951,331 A 8/1990 Pereira
5,007,410 A * 4/1991 DeLaney ..... A47C 21/006 5/694
5,048,975 A * 9/1991 Holbrook ..... A45F 4/02 190/2
5,063,912 A 11/1991 Hughes
5,076,260 A * 12/1991 Komatsu ..... A47C 21/006 601/47
5,107,558 A * 4/1992 Luck ..... A47C 27/146 5/702
5,188,096 A * 2/1993 Yoo ..... A61H 23/0263 601/57
5,357,642 A * 10/1994 Clute ..... A47D 13/08 5/632
5,437,607 A * 8/1995 Taylor ..... A61H 1/00 5/915
5,437,608 A * 8/1995 Cutler ..... A61H 1/00 5/915
5,464,381 A 11/1995 Wilson
5,588,164 A 12/1996 Proulx
5,639,145 A * 6/1997 Alderman ..... A47C 7/021 297/188.04
5,660,597 A 8/1997 Fox et al.
5,711,045 A 1/1998 Caster et al.
5,771,514 A * 6/1998 Wilhoit ..... A47G 9/1027 5/421
5,797,860 A 8/1998 Moriyasu
5,816,910 A 10/1998 Steele et al.
5,865,771 A 2/1999 Shuto et al.
6,059,667 A 5/2000 Pinch
6,142,963 A 11/2000 Black et al.
6,170,602 B1 * 1/2001 Mann ..... A47C 21/006 181/141
6,175,981 B1 * 1/2001 Lizama ..... A47D 9/02 5/655
6,178,577 B1 * 1/2001 Chien-Chuan ..... A47C 21/006 5/694
6,224,380 B1 5/2001 Lo et al.
6,378,940 B1 4/2002 Longoria et al.
6,431,646 B1 8/2002 Longoria
6,647,572 B2 * 11/2003 Lee ..... H01L 31/022408 257/E31.125
6,648,840 B2 * 11/2003 Cutler ..... A61H 23/0263 601/15
6,682,494 B1 * 1/2004 Sleichter, III ..... A61H 23/02 601/57
6,723,059 B1 * 4/2004 Park ..... A47C 21/006 5/915
6,929,612 B2 * 8/2005 Mangano ..... A61H 11/00 601/71
7,036,880 B1 5/2006 Goodman
7,346,949 B2 3/2008 Kamrin-Balfour
7,486,197 B1 * 2/2009 Frazier ..... A47G 9/0223 2/69.5
7,703,848 B1 4/2010 Cochran et al.
8,142,375 B2 * 3/2012 Gaspard ..... A61B 5/11 600/22
8,144,001 B1 * 3/2012 D'Souza ..... A47C 19/22 340/435
8,292,750 B2 10/2012 Gregorian
8,517,911 B1 * 8/2013 Thompson ..... A61H 23/0236 600/27
8,769,737 B1 * 7/2014 Duggins ..... A47D 7/00 5/101
8,931,127 B1 * 1/2015 Moses ..... A47C 27/142 2/65
9,357,855 B2 * 6/2016 Gersin ..... A47C 21/006
2002/0128572 A1 * 9/2002 Chang ..... A47C 21/006 601/148
2002/0169398 A1 * 11/2002 Hancock ..... A61H 23/02 601/15
2003/0121104 A1 * 7/2003 Bretschger ..... A47C 21/006 5/694
2004/0136550 A1 * 7/2004 Park ..... A47C 21/006 381/301
2006/0000023 A1 * 1/2006 Wilson ..... A47C 21/048 5/655
2006/0010605 A1 * 1/2006 Kamrin-Balfour ..... A47C 7/72 5/655
2007/0086612 A1 * 4/2007 Nishibori ..... A47C 21/003 381/333
2007/0213646 A1 * 9/2007 Han ..... A47G 9/1045 601/57
2008/0106421 A1 * 5/2008 Adams ..... A61B 5/0002 340/573.1
2008/0201855 A1 * 8/2008 Groves ..... A47D 5/006 5/655
2009/0188048 A1 * 7/2009 Shlomo ..... A47C 21/046 5/691
2010/0223731 A1 * 9/2010 Chang ..... A47C 7/383 5/657
2010/0231400 A1 * 9/2010 Von Mohr ..... A47G 27/0225 340/665
2010/0262050 A1 * 10/2010 Gasparovich ..... A47C 21/006 601/57
2011/0167565 A1 * 7/2011 Abadi ..... A47C 21/046 5/724
2012/0058861 A1 * 3/2012 Satut ..... A63B 6/00 482/8
2012/0131747 A1 * 5/2012 Sclare ..... A47D 13/083 5/421
2013/0043988 A1 * 2/2013 Bruno ..... A47G 9/0253 340/407.1
2013/0109931 A1 * 5/2013 Ng ..... A47D 15/003 600/301
2013/0225913 A1 * 8/2013 Dunn ..... A61H 23/02 600/27

(56) References Cited

U.S. PATENT DOCUMENTS

| | | | | |
|---|---|---|---|---|
| 2014/0250592 | A1* | 9/2014 | Karp | A47D 15/00 5/108 |
| 2015/0040315 | A1* | 2/2015 | Gersin | A47C 21/006 5/417 |
| 2015/0128349 | A1* | 5/2015 | Padilla | A47D 5/006 5/655 |

OTHER PUBLICATIONS

International Search Report, International application No. PCT/US2015/043593, dated Oct. 23, 2015.

* cited by examiner

PORTABLE VIBRATING BABY SOOTHING MAT

CROSS-REFERENCE TO RELATED APPLICATIONS

This application is a continuation-in-part of U.S. application Ser. No. 14/454,082 filed Aug. 7, 2014 which, in turn, claim the benefit of U.S. provisional application Ser. No. 61/863,905 filed Aug. 9, 2013, the disclosures of which are hereby incorporated in their entirety by reference herein.

TECHNICAL FIELD

The present disclosure relates to a portable mat configured to produce vibrations to calm an infant or small child.

BACKGROUND

As many parents have experienced, a sensation of motion is useful when lulling a newborn or infant to sleep. As examples, adults may rock a child in their arms, rock the child in a rocking chair or glider, place the child in a bouncer chair, or even place the child in a car seat and drive until the sound and feel of the vehicle soothe the child to sleep.

Various known devices make use of electric motors or other mechanisms to attempt to reproduce these sensations of motion. Such devices permit a parent or caregiver to free their hands while the child is soothed by the device. Many such examples, such as vibrating bouncer chairs, include rigid frames into which the child is placed. Others include large flat plates or housings that contain vibratory or other motion devices.

SUMMARY

A flexible vibrating mat for soothing a child according to the present disclosure includes a plurality of electric vibratory motors and a plurality of cylindrical motor housings. Each motor housing is associated with a single electric vibratory motor and is generally the same size as the associated electric vibratory motor. The mat additionally includes a controller. The controller is configured to selectively electrically couple the plurality of electric vibratory motors to an electric power supply. The mat also includes a flexible core coupled with the plurality of motor casings. The mat further includes a water-resistant cover covering the core, the plurality of motor casings, and the controller.

In some embodiments, each motor casing has a long dimension less than or equal to two inches. In some embodiments, the motor housings each have a central axis. In such embodiments, the motor housings are coupled to the core with the plurality of central axes being generally parallel. The controller may be further configured to selectively control the motors according to a first speed of rotation and a second speed of rotation. Some embodiments further include a speaker and an audio connection. In such embodiments, the audio connection is adapted to interface with an audio source, and the controller is further configured to selectively electrically couple the speaker to the power source. Other embodiments include a heating element. In such embodiments, the cover is further configured to cover the heating element and the controller is further configured to selectively electrically couple the heating element to the power source.

A flexible mat according to the present disclosure includes a flexible cushion layer and a plurality of vibration device assemblies coupled to the flexible layer. Each vibration device assembly includes an electric vibratory device and a housing associated with the electric vibratory device. Each housing has a central axis, and the central axes of the housings are arranged to be generally parallel to facilitate rolling of the mat. The mat additionally includes a controller configured to selectively electrically couple at least one of the plurality of vibratory devices to a power supply. The mat has a neutral state in which the mat is generally planar and a deformed state in which the mat is curved to fit a curved surface.

In some embodiments, the controller is configured to selectively control the vibratory devices according to a first vibratory speed and a second vibratory speed. The plurality of vibratory devices may include a plurality of eccentric rotating mass vibratory motors. In some embodiments, the cushion layer includes a plurality of interior pockets. In such an embodiment, the plurality of vibratory device assemblies is arranged within the plurality of interior pockets. The power supply may be a rechargeable battery.

A baby soothing mat according to the present disclosure includes a flexible core, a plurality of vibratory devices, and a plurality of vibratory device housings. The vibratory device housings are coupled to the flexible core and associated with the plurality of vibratory devices. Each of the plurality of housings retains a respective one of the plurality of vibratory devices and is substantially the same size as the respective one of the plurality of vibratory devices. The mat additionally includes a controller. The controller is configured to selectively electrically couple the plurality of vibratory devices to a power supply. The mat further includes a flexible cover covering the flexible core and plurality of vibratory device housings, wherein the cover, core, and devices may be rolled or folded by hand along an S or L axis, or diagonally.

In some embodiments, the plurality of vibratory devices includes a plurality of eccentric rotating mass vibratory motors. In such embodiments, the plurality of eccentric rotating mass vibratory motors may define a plurality of axes of rotation, with the axes of rotation being generally parallel. In one embodiment, the flexible core includes a plurality of interior cavities with the plurality of vibratory devices disposed within the plurality of interior cavities. In another embodiment, the flexible core has an area and a thickness, and the vibratory devices are distributed generally evenly across the area. In a further embodiment, each of the plurality of vibratory device housings is generally cylindrical with a dimension of a long axis being equal to or less than two inches.

Embodiments according to the present disclosure provide a number of advantages. For example, the present disclosure provides a mat that is lightweight and may be easily folded or rolled for portability. Furthermore, embodiments according to the present disclosure are sufficiently flexible to be placed onto any non-planar surface, such as the interior of a car seat or infant carrier or can even be crumpled into a ball.

The above advantage and other advantages and features of the present disclosure will be apparent from the following detailed description of the preferred embodiments when taken in connection with the accompanying drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In some situations, it is desirable to have a mechanism for producing soothing vibrations that is also highly flexible. As an example, a parent may wish to produce vibrations in a child's car seat to calm the child. In such a circumstance, the vibration-producing device must be sufficiently flexible to adapt its shape to the interior of the car seat. Furthermore, in some medical situations it is desirable to soothe a child without touching them. Premature babies are often placed into incubators in a neonatal intensive care unit ("NICU"). Such babies may need calming, but should not be handled excessively. Similarly, excessively jaundiced babies may be treated using phototherapy, in which the baby is undressed and exposed to high intensity fluorescent lighting for extended periods of time. In these and other scenarios it is helpful to have a mechanism for soothing the child that fits into existing medical equipment, such as an incubator or phototherapy array. Known soothing devices, having frames or flat vibratory plates, are too rigid to accommodate non-planar shapes such as the interior of a car seat or medical device.

Figure 1:
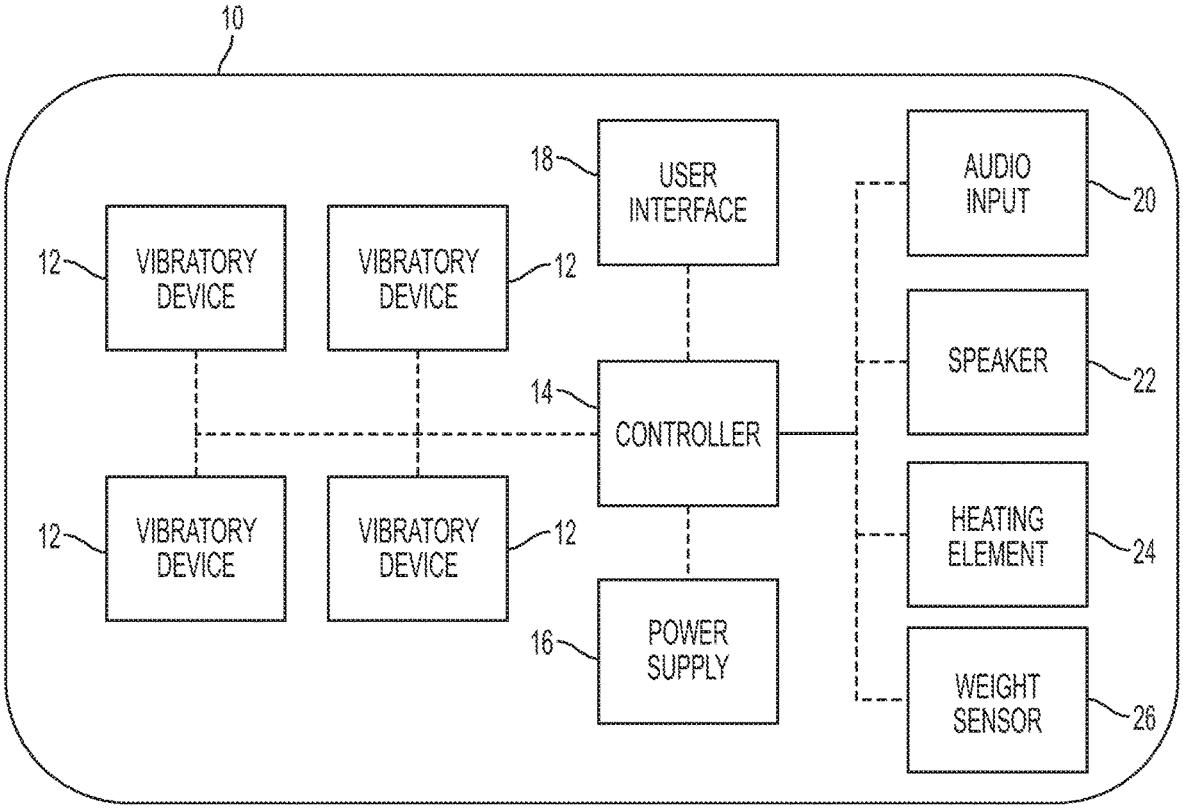
FIG. 1 schematically illustrates a soothing mat according to the present disclosure.

Referring now to FIG. 1, a soothing mat 10 according to the present disclosure includes a plurality of vibratory devices 12 electrically coupled with and under the control of at least one controller 14. The vibratory devices 12 are each provided with a separate housing, as will be discussed below in conjunction with FIGS. 2*a* and 2*b*. In a preferred embodiment, the vibratory devices 12 are eccentric rotating mass vibratory motors. In other embodiments, the vibratory devices 12 include linear drive vibratory motors or other appropriate vibration-producing mechanisms. The vibratory devices 12 may be electrically coupled to each other in series, parallel, or combination thereof as appropriate.

The controller 14 is additionally electrically coupled with a power supply 16. In a preferred embodiment, the power supply 16 includes a rechargeable battery or batteries, such as a Li-Ion battery pack, having an externally accessible charging port such as a USB charging port. In other embodiments, the power supply 16 may include replaceable non-rechargeable batteries, an AC wall plug, solar cell, or other appropriate power supply.

The controller 14 is in communication with a user interface 18. The user interface 18 may include at least one user-activated control, such as a push-button. The controller 14 selectively controls the vibratory devices 12 in response to user inputs to the user interface 18. In a preferred embodiment, the user interface includes a first user-actuated control, which may be referred to as a POWER button, and a second user-actuated control, which may be referred to as a MODE button. In response to a user actuation of the POWER button, the controller 14 selectively electrically couples or decouples the vibratory devices 12 to the power supply 16. In response to a user actuation of the MODE button, the controller 14 controls the vibratory devices 12 according to various vibration modes of operation. The POWER button and/or the MODE button may be press & hold buttons to prevent babies from turning the mat on or off with flailing limbs. The functions of the controller 14 will be described in further detail in conjunction with FIG. 5 below. In various embodiments, the user interface 18 may include additional controls such as a vibration intensity dial. The user interface 18 may also include a user information display, such as an indicator light or other signaling device. In such embodiments, the controller 14 is configured to transmit information indicative of an operating state of the vibratory devices to a user. Examples of such information include whether the vibratory devices are ON or OFF and what vibration mode is active.

The mat 10 further includes an audio input 20 and a speaker 22 in communication with the controller 14. The audio input 20 may include an auxiliary audio port, a Bluetooth device, or other appropriate means of connecting to an audio source. The controller 14 is configured to play audio received via the audio input 20 through the speaker 22. In some embodiments, the controller 14 may include non-transitory memory storage provided with at least one pre-recorded audio signal, such as white noise or nature sounds. In such embodiments, the controller 14 may be configured to play the pre-recorded audio signal(s) through the speaker 22. The user interface 18 may include additional user-actuated controls and displays corresponding to functions of the audio input 20 and speaker 22.

The mat 10 further includes a heating element 24 and a weight sensor 26 in communication with the controller 14. The heating element 24 is an electric heating element configured to produce a warming sensation in the mat 10. The controller 14 is configured to selectively activate the heating element 24 response to a user input to the user interface 18 and further in response to a signal from the weight sensor 26 exceeding a threshold value, where the threshold signal value corresponds with a typical weight of a newborn child. The controller 14 thus avoids unintentional activation of the heating element 24 when a child is not present. The user interface 18 may include additional user-actuated controls and displays corresponding to functions of the audio input heating element 24.

Variations on the above-described mat are, of course, possible. For example, embodiments according to the present disclosure may omit the audio input, speaker, heating element, weight sensor, or a combination thereof. Furthermore, embodiments according to the present disclosure may include additional features or functions as appropriate.

Figure 2A:
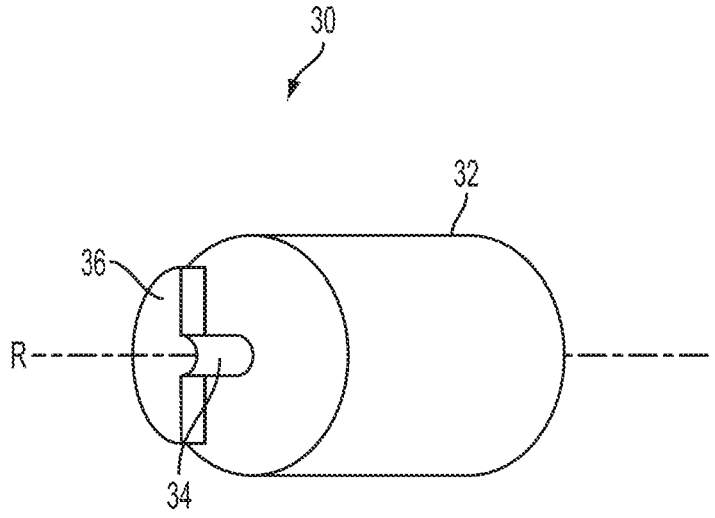
FIGS. 2*a* and 2*b* illustrate isometric and cross section views of a vibratory motor.
Figure 2B:
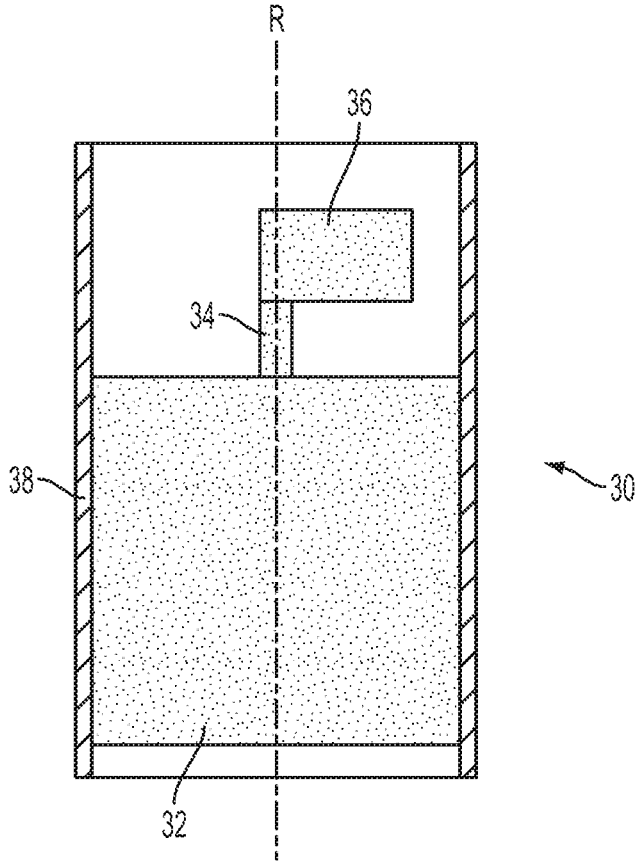

Referring now to FIGS. 2*a* and 2*b*, an eccentric rotating mass vibratory motor ("ERM") assembly 30 is illustrated as may be used in conjunction with the present disclosure. The ERM assembly 30 includes an ERM motor 32 including a shaft 34 and an eccentric mass 36. In a preferred embodiment, the ERM motor 32 is generally cylindrical. The ERM motor 32 is configured to generate rotation in the shaft 34 about a rotation axis R in response to an electrical current. An eccentric (i.e. asymmetric about the axis of rotation R) mass 36 is coupled with the shaft 34. Driven rotation of the eccentric mass 36 about the axis of rotation R generates vibratory motion in the ERM assembly 30. The ERM assembly 30 further includes a housing 38 retaining and protecting the ERM motor 32, shaft 34, and eccentric mass 36. In a preferred embodiment, the housing 38 is approximately the same shape and size as the ERM motor 32. The housing 38 is only slightly larger than the ERM motor 32 and sized to retain only a single ERM motor 32. In a particularly preferred embodiment, the housing 38 is cylindrical in shape with a diameter less than or equal to one inch and a length less than or equal to two inches. Most preferably, the housing 38 has a diameter less than or equal to one half of an inch and a length less than or equal to one inch.

Figure 3A:
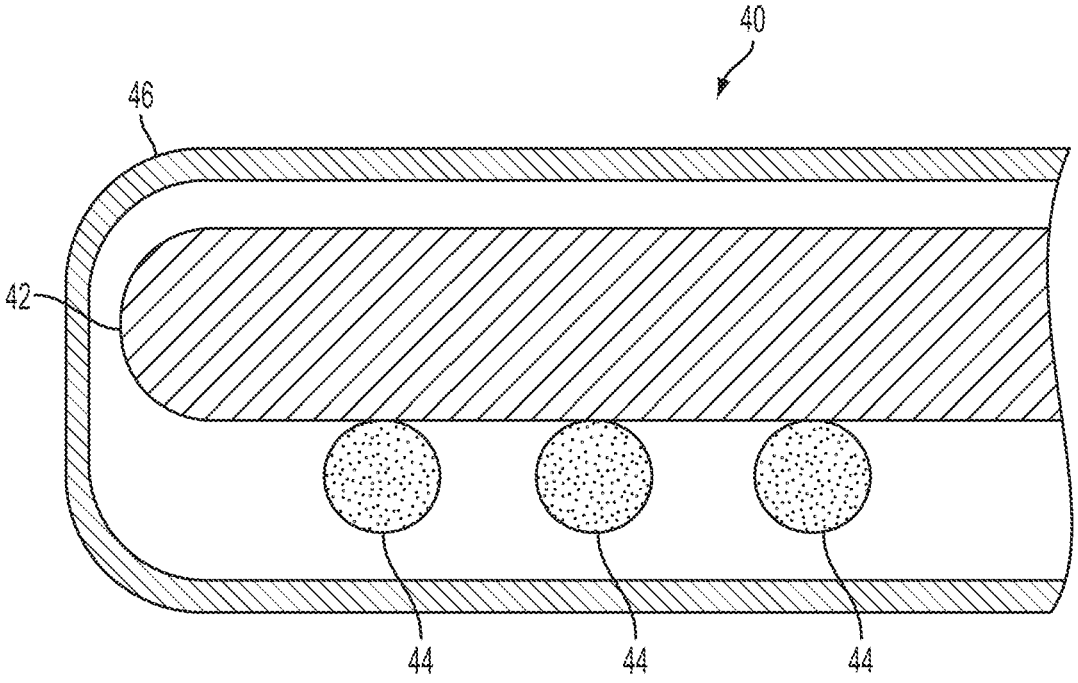
FIGS. 3*a* and 3*b* illustrate cross sections of embodiments of a soothing mat according to the present disclosure.
Figure 3B:
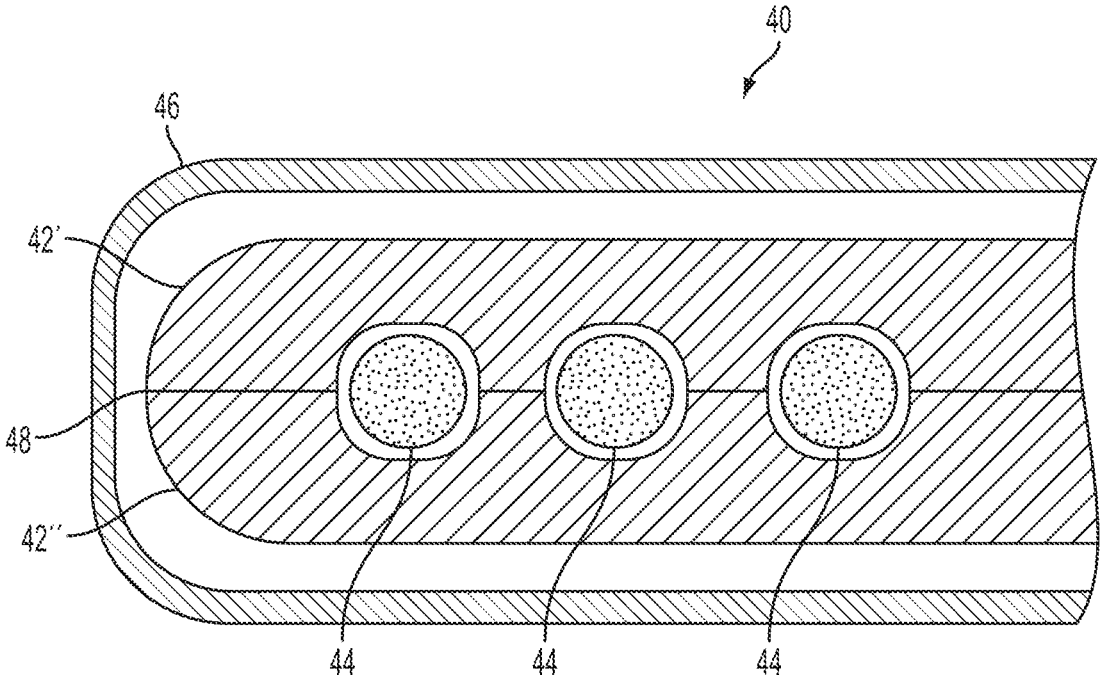

Referring now to FIG. 3*a*, a cross section of a soothing mat 40 according to the present disclosure is illustrated. The soothing mat 40 includes a flexible core layer 42. The core layer may be made of any flexible cushioning material including, but not limited to, PVC, rubber, and natural fibers. The soothing mat 40 additionally includes a plurality of vibratory device assemblies 44 coupled to a lower surface of the core layer 42. The soothing mat 40 further includes a cover 46 fitted about the core layer 42 and vibratory device assemblies 44. In a preferred embodiment, the cover 46 is made of a water-resistant fabric. In other embodiments, the cover 46 may be waterproof. Additional removable decorative layers may be fitted about the cover 46. Referring now to FIG. 3*b*, another embodiment of a soothing mat 40 according to the present disclosure is illustrated. In this embodiment, the flexible core includes an upper layer 42' and a lower layer 42". The upper layer 42' and/or lower layer 42" are provided with cavities along an inner surface 48. When fitted together, the cavities define pockets. The vibratory device assemblies 44 are coupled to and retained within the pockets. Electrical connections (not illustrated) among the vibratory device assemblies and controller (not illustrated) may be similarly routed between the upper layer 42' and lower layer 42". Advantageously, this embodiment provides additional protection for the vibratory device assemblies 44. In a variation of this embodiment, the cover 46 is omitted and exterior surfaces of the upper layer 42' and lower layer 42" are made of water resistant material.

Figure 4A:
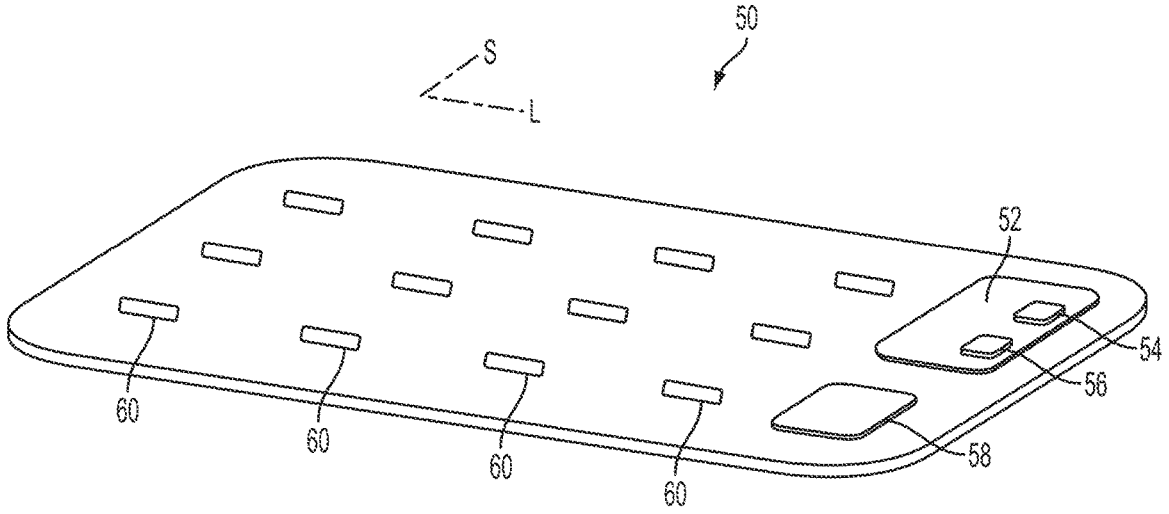
FIGS. 4*a* and 4*b* illustrate additional cross sections of embodiments of a soothing mat according to the present disclosure.

Referring now to FIG. 4*a*, an additional cross sectional view of a soothing mat 50 according to the present disclosure is illustrated. The soothing mat 50 includes a controller 52 coupled to a first user-actuated control 54 and a second user-actuated control 56. In a preferred embodiment, the first control 54 is a POWER button and the second control 56 is a MODE button. While the controller 52 is retained within a cover (not shown in this view), the first control 54 and second control 56 are externally accessible. For example, the buttons may be retained within the cover at located that are indicated by embroidery, protrusions, or other markings such that they can be located and pressed through the cover. Alternatively, the cover may include an aperture allowing access to the button. To prevent accidental activation by the infant, one or both buttons may be press & hold buttons that do not activate the corresponding feature unless held for several seconds. The soothing mat 50 additionally includes a power supply 58 and a plurality of vibratory device assemblies 60. In this embodiment, the power supply 58 is an internally stored battery sharing a common internal compartment with the controller 52 and vibratory device assemblies 60. In additional embodiments, the power supply 58 may be stored in a separate pocket for easy access. Such an embodiment is particularly advantageous when used in conjunction with non-rechargeable batteries as it permits easy battery replacement. Similarly, the controller 52 may be retained within a separate pocket rather than the common internal compartment with the vibratory device assemblies 60.

In a neutral (e.g. unrolled or unfolded) state, the soothing mat 50 is generally rectangular, having a long axis L and a short axis S defining a generally planar area. Each vibratory device assembly, which is preferably configured similarly as the vibratory device assembly 30 illustrated in FIG. 2, has a central axis. In a preferred embodiment, the central axis corresponds with or is aligned with an axis of rotation of a vibratory device in the assembly. The vibratory device assemblies 60 are arranged generally equally about the area of the soothing mat 50 such that the central axes of the respective devices are generally parallel with the long axis L.

As may be observed, the relatively small size of each respective vibratory device assembly 60, in conjunction with the common arrangement of the respective central axes and furthermore the flexibility of the core and cover, enables easy rolling or folding of the mat 50 by hand. In addition, while the mat has a generally planar neutral state, the mat 50 may be arranged on or in nonplanar surfaces as there is no rigid structure defining a resting shape of the mat 50. As an example, the mat 50 may be fit within a car seat, bouncer chair, or incubator. Furthermore, the absence of a rigid structure reduces the weight of the mat. As an example, a "newborn size" mat, approximately eight by eleven inches, may be built weighing approximately six ounces. A larger mat, approximately fourteen by twenty-one inches, may be built weighing approximately 18 ounces.

Figure 4B:
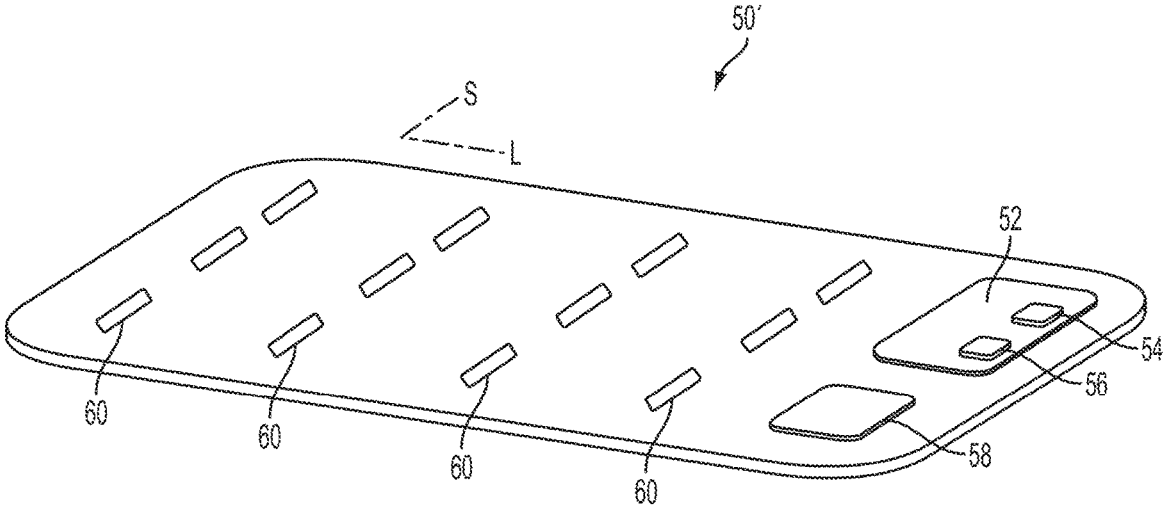

Referring now to FIG. 4*b*, another embodiment of a soothing mat 50' is illustrated. The configuration of the soothing mat 50' is generally similar to that illustrated in FIG. 4*a*. In this embodiment, the plurality of vibratory device assemblies 60 is arranged with the central axes being generally parallel with the short axis S.

Other embodiments may include vibratory device assemblies arranged in other ways, such as with the respective central axes not being generally parallel with each other.

Figure 5:
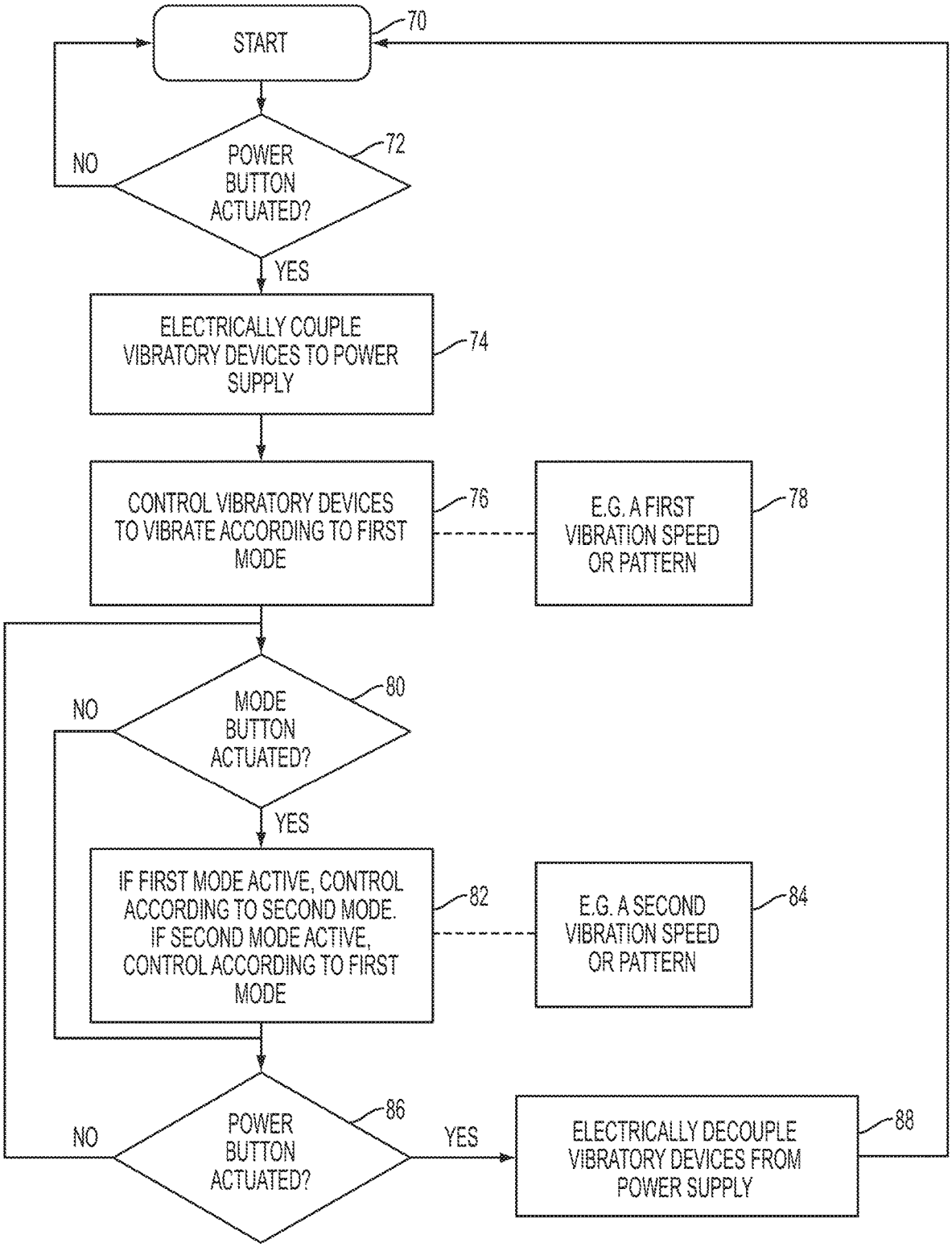
FIG. 5 is a flow chart illustrating a method of operating a soothing mat according to the present disclosure.

Referring now to FIG. 5, a method of controlling a soothing mat according to the present disclosure is illustrated in flowchart form. Control begins at block 70 with the mat turned off (i.e. vibratory motors are electrically disconnected from a power source). A determination is made of whether a POWER button has been actuated, as illustrated at operation 72. If no, control returns to block 70. If yes, then the vibratory devices are electrically coupled to a power supply, as illustrated at block 74. The vibratory devices are controlled to vibrate according to a first mode, as illustrated at block 76. The first mode may include a first vibrational speed, a first vibrational pattern, and/or activating only a first portion of the vibratory devices, as illustrated at block 78. For example, the first mode may produce between 50 and 70 beats per minute to simulate an adult resting heartbeat.

A determination is made of whether a MODE button is actuated, as illustrated at operation 80. If yes, then an active mode is toggled between first and second modes, as illustrated at block 82. If the first mode was active, then control changes to the second mode. If the second mode was active, then control changes to the first mode. The second mode may include a second vibrational speed, a second vibrational pattern, and/or activating a second portion of the vibratory devices, as illustrated at block 84. For example, the second mode may produce between 100 and 140 beats per minute to simulate an elevated adult heart rate, such as sometimes occurs during pregnancy. Control then proceeds to operation 86. Similarly, if a determination is made at operation 80 that the MODE button was not actuated, control proceeds to operation 86.

A determination is made of whether a POWER button has been actuated, as illustrated at operation 86. If no, control returns to operation 80. If yes, then the vibratory devices are electrically decoupled from the power supply, as illustrated at block 88. Control then returns to block 70.

Variations on the above control method are, of course, possible. In some embodiments, more than two modes are implemented, and an actuation of the MODE button continues to cycle through the available modes. Some embodiments are provided with a timer function, wherein when activated the timer function electrically decouples the vibratory devices from the power supply after a threshold time has elapsed. In embodiments including a speaker, additional control operations may be implemented to selectively activate and deactivate the speaker. Similarly, additional control steps may be included in embodiments including a heating element or other additional features.

As can be seen from the various embodiments, the present invention provides a mat that may be easily folded or rolled. The mat may thus be fit within nonplanar structures such as car seats or incubators. Furthermore, the present invention is portable and lightweight relative to known devices.

While the best mode has been described in detail, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A flexible vibrating mat for soothing a child adapted to fit within a car seat, bouncer chair, or incubator, the mat comprising:

a flexible core;

a plurality of electric vibratory motors;

a plurality of cylindrical motor housings, each motor housing being associated with and enclosing a single one of the plurality of electric vibratory motors, the plurality of cylindrical motors housings mounted to the flexible core in a manner that permits the flexible core to conform to a curved surface, wherein the flexible core is configured to be curved for an entire distance between at least two neighboring motors of the electrical vibratory motors, wherein the mat extends in a first direction fora first length and a second direction for a first width smaller than the first length, wherein the at least two neighboring motors extend in (i) a third direction for a second length and (ii) a fourth direction or a diameter for a second width that is smaller than the second length, wherein the first and third directions are substantially the same and the second and fourth directions are substantially the same, and wherein a distance between at least two neighboring ones of the cylindrical motor housings is greater than a diameter of at least one of the neighboring ones of the cylindrical motor housings;

a controller configured to selectively electrically couple the plurality of electric vibratory motors to an electric power supply; and a water-resistant cover covering the core, the plurality of motor housings, and the controller.

2. The flexible vibrating mat of claim 1, wherein the flexible core comprises a lower layer and an upper layer defining a plurality of pockets therebetween and wherein the cylindrical motor housings are mounted in the pockets.

3. The flexible vibrating mat of claim 1, wherein each of the plurality of motor housings has a central axis, the motor housings being coupled to the core with the respective central axes being generally parallel.

4. The flexible vibrating mat of claim 1, wherein the controller is further configured to selectively control the motors according to a first vibratory speed and a second vibratory speed.

5. The flexible vibrating mat of claim 1, further comprising a speaker and an audio connection, the audio connection being adapted to interface with an audio source, wherein the controller is further configured to selectively electrically couple the speaker to the power supply.

6. The flexible vibrating mat of claim 1, further comprising a heating element, wherein the cover is further configured to cover the heating element and the controller is further configured to selectively electrically couple the heating element to the power supply.

7. A flexible mat comprising:

a flexible cushion layer;

a plurality of vibration device assemblies coupled to the cushion layer, each vibration device assembly comprising a cylindrical housing and an electric vibratory device enclosed within the cylindrical housing, each housing having a central axis, the central axes of the plurality of housings being generally parallel to facilitate rolling of the mat, wherein the vibration device assemblies are provided in an array of at least three by three vibration device assemblies or more; and a controller configured to selectively electrically couple the plurality of vibratory devices to a power supply, wherein the mat has a neutral state in which the mat is generally planar and a deformed state in which the mat conforms to a curved surface, wherein the mat is configured to be curved for an entire distance between at least two neighboring assemblies of the vibration device assemblies, wherein the mat extends in a first direction for first length and a second direction for a first width that is smaller than the first length, wherein the at least two neighboring assemblies extend in (i) a third direction for a second length and (ii) a fourth direction or a diameter for a second width that is smaller than the second length, wherein the first and third directions are substantially the same and the second and fourth directions are substantially the same, and wherein the entire distance between at least two neighboring ones of the cylindrical housings is greater than a width or a diameter of at least one of the at least two neighboring ones of the cylindrical housings.

8. The flexible mat of claim 7, wherein the controller is configured to selectively control the electric vibratory devices according to a first vibratory speed and a second vibratory speed.

9. The flexible mat of claim 8 wherein the first vibratory speed produces between 50 and 70 beats per minute.

10. The flexible mat of claim 9 wherein the second vibratory speed produces between 100 and 140 beats per minute.

11. The flexible mat of claim 7, wherein the vibratory devices are eccentric rotating mass vibratory motors.

12. The flexible mat of claim 7, wherein the flexible layer defines a plurality of interior pockets, the plurality of vibration device assemblies being disposed within the plurality of interior pockets.

13. The flexible mat of claim 7, wherein the power supply is a rechargeable battery.

14. The flexible mat of claim 7 wherein the controller includes at least one press & hold button.

15. A baby soothing mat of up to fourteen by twenty one inches, comprising:

a flexible core extending along a plane which has S and L axes;

a plurality of vibratory devices;

a plurality of vibratory device housings coupled to the flexible core and associated with the plurality of vibratory devices, each of the plurality of housings retaining a respective one of the plurality of vibratory devices;

a controller configured to selectively electrically couple the plurality of vibratory devices to a power supply; and a flexible cover covering the flexible core and plurality of vibratory device housings, wherein a combination of the cover, core, and devices are configured and structured to be rolled by hand along one of the S axis or the L axis, wherein the flexible core is configured to be curved for an entire distance between at least two neighboring devices of the vibratory devices, and wherein the mat extends in a first direction for a first length and a second direction for a first width smaller than the first length, wherein the at least two neighboring devices extend in (i) a third direction for a second length and (ii) a fourth direction or diameter for a second width that is smaller than the second length, wherein the first and third directions are substantially the same and the second and fourth directions are substantially the same, and wherein a distance between at least two neighboring ones of the vibratory device housings is greater than a width or a diameter of at least one of the at least two neighboring ones of the vibratory device housings.

16. The baby soothing mat of claim 15, wherein the plurality of vibratory devices comprises a plurality of eccentric rotating mass vibratory motors defining a plurality of axes of rotation, the plurality of axes of rotation being generally parallel.

17. The baby soothing mat of claim 15, wherein the flexible core comprises a plurality of interior cavities, the plurality of vibratory devices being disposed within the plurality of interior cavities.

18. The baby soothing mat of claim 15, wherein the flexible core has an area and a thickness and the vibratory devices are distributed generally evenly across the area.

19. The baby soothing mat of claim 15, wherein each of the plurality of vibratory device housings is generally cylindrical with a long dimension being equal to or less than two inches.

20. The baby soothing mat of claim 15, wherein the flexible core is configured to be curved for an entire distance between at least two neighboring motors of the electrical vibratory motors, and wherein the entire distance between the at least two neighboring motors is greater than a width of at least one of the at least two neighboring motors along extending in a plane of extension of the flexible core.

21. A method for soothing a child with a flexible mat adapted to fit within a car seat, bouncer chair, or incubator, the method comprising:

providing the flexible mat for soothing the child, the flexible mat comprising a flexible core, a plurality of electric vibratory motors, a plurality of cylindrical motor housings, and a controller configured to selectively electrically couple the plurality of electric vibratory motors to an electric power supply, wherein:

each motor housing is associated with and enclosing a single one of the plurality of electric vibratory motors, the plurality of cylindrical motor housings mounted to the flexible core in a manner that permits the flexible core to conform to a curved surface, the flexible core is configured to be curved for an entire distance between at least two neighboring motors of the electrical vibratory motors, wherein the mat extends in a first direction for a first length and second directions for a first width that is smaller than the first length, the at least two neighboring motors extend in (i) a third direction for a second length and (ii) a fourth direction for a second width that is smaller than the second length, and the first and third directions are substantially the same and the second and fourth directions are substantially the same, and wherein a distance between at least two neighboring ones of the cylindrical motor housings is greater than a diameter of at least one of the neighboring ones of the cylindrical motor housings; and soothing the child using the flexible mat by selectively activating ones or more of the motors.

* * * * *